US011198984B2

(12) United States Patent
Wu et al.

(10) Patent No.: US 11,198,984 B2
(45) Date of Patent: Dec. 14, 2021

(54) UNDERWATER REPAIR SYSTEM FOR CAVITY REGION OF CONCRETE PANEL ROCK-FILL DAM PANEL

(71) Applicants: NANJING HYDRAULIC RESEARCH INSTITUTE UNDER THE MINISTRY OF WATER RESOURCES, THE MINISTRY OF TRANSPORT AND THE MINISTRY OF ELECTRIC, Jiangsu (CN); CHENGDU BRANCH OF GUODIAN ACADEMY OF SCIENCE AND TECHNOLOGY CO., LTD., Sichuan (CN)

(72) Inventors: Yingli Wu, Nanjing (CN); Ruiji Yi, Chengdu (CN); Sheng Yang, Chengdu (CN); Wanli Guo, Nanjing (CN); Denghua Li, Nanjing (CN); Limin Xiao, Nanjing (CN); Jingping Ming, Nanjing (CN); Qiming Zhong, Nanjing (CN); Hongxia Fan, Nanjing (CN); Hua Fu, Nanjing (CN); Hua Ling, Nanjing (CN); Fang Wang, Nanjing (CN); Ting Shen, Nanjing (CN); Yong Li, Guiyang (CN); Yongyong Cao, Nanjing (CN); Jun Li, Nanjing (CN); Ming Zhang, Nanjing (CN); Zhaosheng Zhang, Nanjing (CN); Zehua Huangfu, Nanjing (CN); Shilin Li, Guiyang (CN); Juhua Zhang, Nanjing (CN); Jiefu Wu, Nanjing (CN); Zhe Hu, Nanjing (CN); Lifei Gong, Nanjing (CN); Gang Wu, Nanjing (CN); Yufeng Huangfu, Nanjing (CN); Chen Chen, Nanjing (CN); Jing Yuan, Nanjing (CN)

(73) Assignees: NANJING HYDRAULIC RESEARCH INSTITUTE UNDER THE MINISTRY OF WATER RESOURCES, THE MINISTRY OF TRANSPORT AND THE MINISTRY OF ELECTRIC, Jiangsu (CN); CHENGDU BRANCH OF GUODIAN ACADEMY OF SCIENCE AND TECHNOLOGY CO., LTD., Sichuan (CN)

( * ) Notice: Subject to any disclaimer, the term of this patent is extended or adjusted under 35 U.S.C. 154(b) by 0 days.

(21) Appl. No.: 17/045,237

(22) PCT Filed: Feb. 13, 2019
(86) PCT No.: PCT/CN2019/075005
§ 371 (c)(1),
(2) Date: Oct. 5, 2020

(87) PCT Pub. No.: WO2019/192267
PCT Pub. Date: Oct. 10, 2019

(65) Prior Publication Data
US 2021/0164183 A1 Jun. 3, 2021

(30) Foreign Application Priority Data
Apr. 4, 2018 (CN) ..... 201810300002.0

(51) Int. Cl.
*E02B 7/00* (2006.01)
*E02B 3/10* (2006.01)
(Continued)

(52) U.S. Cl.
CPC ..... *E02B 7/06* (2013.01); *E02B 3/16* (2013.01); *E02D 15/06* (2013.01); *E02D 37/00* (2013.01)

(58) Field of Classification Search
CPC ... E02B 7/06; E02B 3/16; E02D 15/06; E02D 37/00
(Continued)

(56) References Cited

U.S. PATENT DOCUMENTS 2,756,021 A * 7/1956 Townsend ..... E21B 7/136 175/8
(Continued)

FOREIGN PATENT DOCUMENTS

CN 104912039 A 9/2015
(Continued)

OTHER PUBLICATIONS

International Search Report dated May 15, 2019 for PCT/CN2019/075005.

*Primary Examiner* — Edwin J Toledo-Duran
(74) *Attorney, Agent, or Firm* — Schmeiser, Olsen & Watts, LLP

(57) ABSTRACT

Provided is an underwater repair system for a cavity region of a concrete panel rock-fill dam panel, including a moving
(Continued)

platform, a work cabin, a pressure drainage apparatus, a traction apparatus, and a positioning apparatus; the traction apparatus controlling the movement of the moving platform on the surface of a dam concrete panel; the positioning apparatus transmits a detection position; the work cabin is a pressure cabin, the work cabin being connected to the pressure drainage apparatus, and a drill apparatus and grouting apparatus being arranged in the work cabin; the moving platform moves into the cavity region, and the pressure drainage apparatus starts up to drain the water in the work cabin, a partially closed waterless space being formed inside the work cabin, the drill apparatus drilling the concrete panel at the upper end of the cavity region and the grouting apparatus subsequently implementing grouting to complete the repair.

9 Claims, 1 Drawing Sheet

(51) Int. Cl.
*E02B 7/06* (2006.01)
*E02B 3/16* (2006.01)
*E02D 15/06* (2006.01)
*E02D 37/00* (2006.01)

(58) Field of Classification Search
USPC ..... 173/1, 31, 32, 34, 37, 152; 219/121.63, 219/121.67, 121.84; 408/67, 88, 97, 204, 408/77, 234; 451/41, 58, 439; 29/26 B, 29/824, 402.06; 376/245, 260, 258, 261
See application file for complete search history.

(56) References Cited

U.S. PATENT DOCUMENTS 3,513,517 A * 5/1970 Galbarini ..... B23Q 1/01 29/26 R
3,672,177 A * 6/1972 Manning ..... E21B 41/08 405/227
4,318,391 A * 3/1982 Wachs ..... E02D 9/005 125/14
4,329,094 A * 5/1982 Cooley ..... B23B 41/00 408/234
4,552,594 A * 11/1985 van Voskuilen ..... F16L 58/02 134/180
4,711,604 A * 12/1987 Heimsoth ..... E02D 5/76 405/259.5
4,716,010 A * 12/1987 Gallo ..... G21C 13/06 376/260
4,724,636 A * 2/1988 Tolino ..... B24B 23/08 451/124
5,193,405 A * 3/1993 Oomichi ..... B25J 5/00 73/865.8
5,243,631 A * 9/1993 Cearley ..... G21C 19/207 376/260
5,377,238 A * 12/1994 Gebelin ..... B23Q 9/0078 376/260
5,633,902 A * 5/1997 Moscardini ..... G21C 19/37 376/260
6,219,399 B1 * 4/2001 Naruse ..... G21D 1/02 376/245
6,309,147 B1 * 10/2001 Matsumoto ..... G21C 5/10 408/67
6,555,779 B1 * 4/2003 Obana ..... B23K 26/146 219/121.63
6,610,992 B1 * 8/2003 Macaulay ..... G01B 11/00 250/559.22
6,612,779 B1 * 9/2003 Scuero ..... E02D 17/18 405/107
7,769,123 B2 * 8/2010 Rowell ..... G21C 19/207 376/249
8,371,025 B2 * 2/2013 Kramer ..... G21C 19/02 29/824
8,638,897 B2 * 1/2014 Aoike ..... G21C 17/003 376/249
8,894,467 B2 * 11/2014 Santure ..... B08B 9/093 451/38
9,666,314 B2 * 5/2017 Kramer ..... G21C 19/207
9,827,650 B2 * 11/2017 Santure ..... B24C 3/325
10,037,827 B2 * 7/2018 Kramer ..... G21C 19/07
2010/0192368 A1 * 8/2010 Kramer ..... G21C 19/207 29/824
2010/0238269 A1 * 9/2010 Miralles ..... G01B 11/25 348/44
2010/0296875 A1 * 11/2010 Thomson ..... E02B 17/025 405/224
2011/0203823 A1 * 8/2011 Beaudry ..... B23Q 1/626 173/46
2012/0082535 A1 * 4/2012 Provencher ..... B23C 3/00 414/589

FOREIGN PATENT DOCUMENTS

CN 205421173 U 8/2016
CN 106812119 A 6/2017
CN 107419646 A 12/2017
JP 2003193503 A 7/2003
RU 2297493 C2 4/2007

* cited by examiner

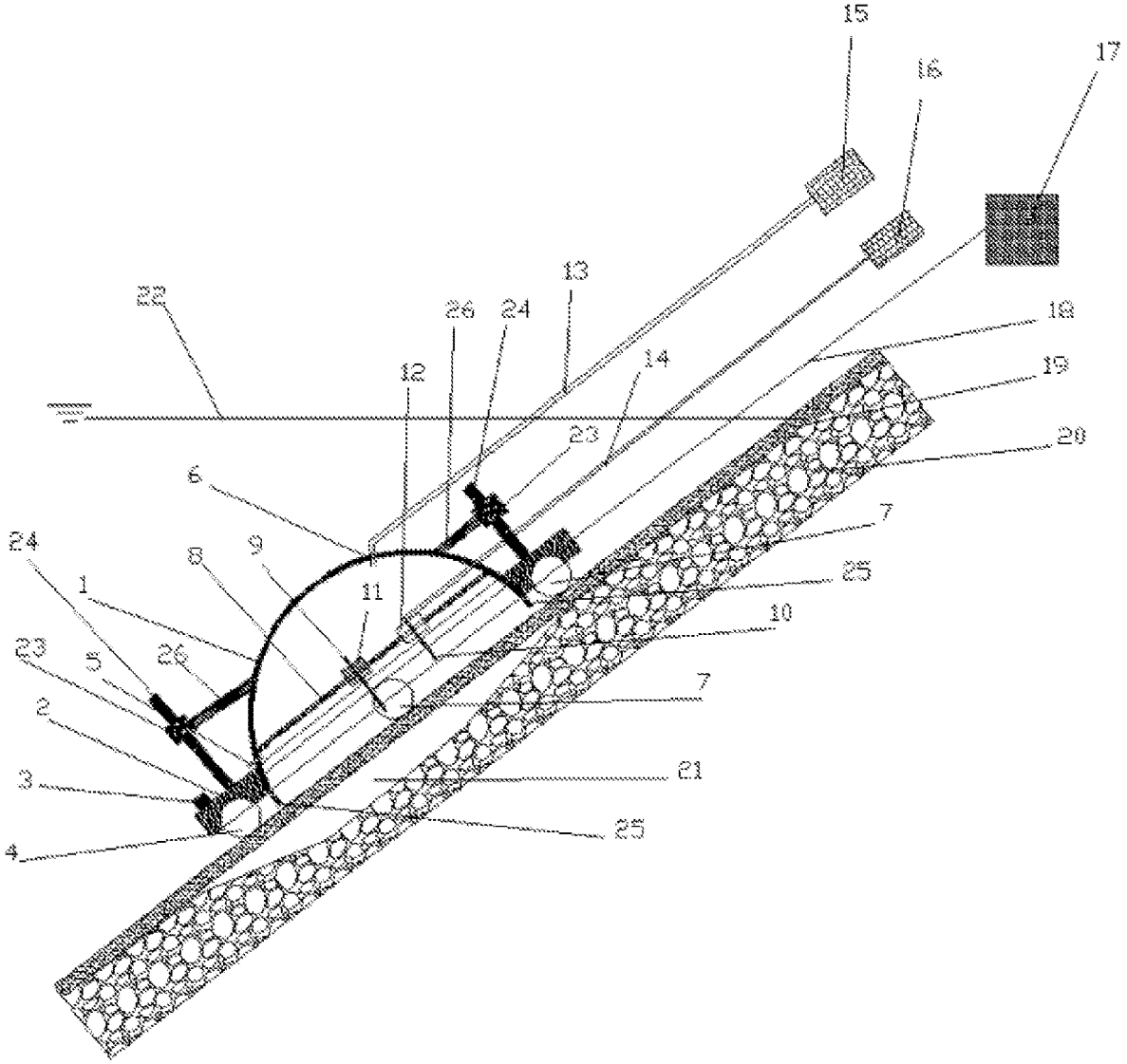
15
16
17
22
26
24
13
18
12
14
19
23
20
6
7
24
8
9
25
1
11
10
23
5
26
7
2
21
3
25
4

UNDERWATER REPAIR SYSTEM FOR CAVITY REGION OF CONCRETE PANEL ROCK-FILL DAM PANEL

CROSS-REFERENCE TO RELATED APPLICATIONS

This application claims priority to PCT Application No. PCT/CN2019/075005 having a filing date of Feb. 13, 2019, which is based on CN Application No. 201810300002.0, having a filing date of Apr. 4, 2018, the entire contents both of which are hereby incorporated by reference.

FIELD OF TECHNOLOGY

The following relates to the field of testing equipment, in particular to an underwater repair system for a cavity region of a concrete panel rock-fill dam panel. The following can realize rapid, efficient and low-cost underwater repair for a cavity region of a concrete panel rock-fill dam. The present patent is completed by relying on the National Key R&D Program "Research on Key Technologies for Risk Management of Plain Reservoir Project" (2017YFC0405005).

BACKGROUND

As a main dam type, concrete panel rock-fill dams are widely used in water conservancy and hydropower projects. Concrete panels are important parts of dam body anti-seepage system, and their safety directly determines the safety of dam body. Affected by the construction quality and external load of dam body, the panel and the lower cushion material are prone to a cavity region, which often appears below the water mark, resulting in great inconvenience to the repair of the cavity region.

At present, there is no effective way for underwater repair of the cavity region of concrete panel rock-fill dam panels. When a large cavity region is found at the lower part of the concrete panel and it threatens the safety of the dam body, the reservoir is generally emptied to expose the cavity region above the water mark and the cavity region is repaired by grouting. This method is a huge waste of water resource and causes huge economic losses to the enterprises. Therefore, it is particularly important to design a simple and effective underwater repair device for a cavity region of a concrete panel rock-fill dam panel.

SUMMARY

An aspect relates to a simple and efficient underwater repair system for a cavity region of a concrete panel rock-fill dam panel to realize the rapid and low-cost underwater repair of a cavity region of a concrete panel rock-fill dam panel.

To achieve the above technical purpose, the following technical solutions are adopted in embodiments of the present invention:

An underwater repair system for a cavity region of a concrete panel rock-fill dam panel, comprising a moving platform, a work cabin, a pressure drainage apparatus, a traction apparatus and a positioning apparatus; wherein the work cabin and the positioning apparatus are arranged on the moving platform, the traction apparatus controls the movement of the moving platform on the surface of a dam concrete panel; the positioning apparatus transmits a detection position; the work cabin is a pressure cabin with an upper closure structure, the work cabin is connected to the pressure drainage apparatus, and a drill apparatus and a grouting apparatus are arranged in the work cabin; the moving platform moves into a cavity region, the pressure drainage apparatus starts up to drain the water in the work cabin, a partially closed waterless space is formed inside the work cabin, the drill apparatus drills the panel at the upper end of the cavity region and the grouting apparatus subsequently implements grouting to complete the repair.

As a further improvement of embodiments of the present invention, a first guide rail is further comprised; the first guide rail is vertically fixed on the moving platform; and the work cabin is connected to the first guide rail through a connecting rod and slides along the first guide rail by the driving of a driving motor. When the guide rail is arranged, the work cabin can be controlled to move downward along the guide rail when reaching the cavity region, making the surface of a bottom panel of the work cabin pressed tightly to facilitate pressure drainage. The edge of the bottom of the work cabin is made of a flexible rubber material, which can further make the surface of the bottom panel of the work cabin pressed tightly; the outer side of the flexible rubber bottom edge is provided with a flexible pressure water-stopping material so as to seal the work cabin under the pressure of water.

As a further improvement of embodiments of the present invention, a second guide rail is further comprised, and the drill apparatus and the grouting apparatus are arranged on the second guide rail. The second guide rail is provided so that the movement of the drill apparatus and the grouting apparatus is more flexible, without relying on the moving platform, thereby facilitating the alternate operation of the drill apparatus and the grouting apparatus.

As a further improvement of embodiments of the present invention, the pressure drainage apparatus comprises a pneumatic pump, a pneumatic pressure tube and a one-way check valve, wherein the one-way check valve is arranged on the work cabin, the pneumatic pressure tube is connected to the work cabin; the pneumatic pump drives to press the high-pressure gas into the work cabin through the pneumatic pressure tube, and the water in the work cabin is discharged through the one-way check valve to form a partially closed waterless space inside the work cabin.

As a further improvement of embodiments of the present invention, an imaging apparatus and a lighting apparatus are further comprised, wherein the imaging apparatus and the lighting apparatus are arranged in the work cabin. The imaging apparatus and the lighting apparatus can be used to monitor the repair work in real time, which is convenient for the control operation of the repair work.

As a further improvement of embodiments of the present invention, the moving platform is composed of a driving apparatus, a crawler belt, a driving wheel, a driven wheel and a device carrier; the device carrier is disposed on the crawler belt, and the driving apparatus controls the driven wheel and the driving wheel to rotate to drive the rotation of the crawler belt so as to move the device.

As a further improvement of embodiments of the present invention, the traction apparatus comprises a hoister and a traction cable; the traction cable is connected to the moving platform, and the device is controlled to reciprocate up and down along the panel by the driving force of the moving platform and the traction of the hoister.

As a further improvement of embodiments of the present invention, an electromagnet is provided at the bottom of the moving platform. During the movement, the electromagnet is magnetized by the input current, and the steel bars inside the reinforced concrete are adsorbed, so that the device can be better adsorbed on the panel.

As a further improvement of embodiments of the present invention, the front end of the moving platform is provided with a high-pressure cleaning nozzle. The high-pressure cleaning nozzle is arranged to clean the sludge on the repair surface, which facilitates the smooth movement of the moving platform and the smooth operation of the drill apparatus and the grouting apparatus.

As a further improvement of embodiments of the present invention, the pressure drainage apparatus can adjust the internal pressure of the work cabin according to actual needs, thereby not only ensuring sufficient pressure difference inside and outside the work cabin to provide sufficient reaction force to the drill apparatus but also preventing the pressurized water inside the cavity region from spewing after the panel is drilled through.

As a further improvement of embodiments of the present invention, the positioning apparatus can be positioned by a satellite positioning system.

As a further improvement of embodiments of the present invention, a spraying apparatus is further comprised, and the spraying apparatus is arranged in the work cabin. Spraying repair of non-penetrating cracks on the surface of concrete panels can be achieved.

The system of embodiments of the present invention can complete the economical and efficient underwater repair of the cavity region of concrete panel rock-fill dam panels by forming a partially closed waterless space inside the work cabin and by combining the drill apparatus and the grouting apparatus.

BRIEF DESCRIPTION

Some of the embodiments will be described in detail, with references to the following FIGURES, wherein like designations denote like members, wherein:

FIG. 1 is a schematic diagram of the structure of an apparatus of embodiments of the present invention.

Wherein, 1. work cabin, 2. device carrier, 3. positioning apparatus, 4. drive wheel, 5. one-way check valve, 6. pressure drainage apparatus, 7. driven wheel, 8. second guide rail, 9. drill pipe, 10. grouting head, 11. drill apparatus, 12. grouting apparatus, 13. pneumatic pressure tube, 14. grouting pipe, 15. pneumatic pump, 16. grouting pump, 17. hoister, 18. traction cable, 19. concrete panel, 20. cushion, 21. panel cavity region, 22. water mark, 23. work cabin vertical movement drive motor, 24. first guide rail, 25. rubber bottom edge, 26. work cabin connecting rod.

DETAILED DESCRIPTION

The technical solutions of embodiments of the present invention will be further described below in conjunction with the embodiments and the attached drawings.

Embodiment 1

The system equipment as shown in FIG. 1 comprises a moving platform, a work cabin 1, a pressure drainage apparatus 6, a traction apparatus and a positioning apparatus 3; the work cabin 1 and the positioning apparatus 3 are arranged on the moving platform, and the traction apparatus controls the movement of the moving platform on the surface of a dam concrete panel 19; and the positioning apparatus 3 transmits a detection position;

The pressure drainage apparatus 6 comprises a pneumatic pump 15, a pneumatic pressure tube 13 and a one-way check valve 5, the one-way check valve 5 is arranged on the work cabin 1, and the pneumatic pressure tube 13 is connected to the work cabin 1;

The work cabin 1 is a pressure cabin with an upper closure structure, the work cabin 1 is connected to the pneumatic pressure tube 13, the work cabin 1 is provided with a drill apparatus 11 and a grouting apparatus 12; the edge of the bottom of the work cabin 1 is made of a flexible rubber material 25; a flexible pressure water-stopping material is arranged on an outer side of the flexible rubber bottom edge 25; the moving platform moves to a cavity region 21, and the pressure drainage apparatus 6 starts to drain the water in the work cabin 1 to form a partially closed waterless space inside the work cabin 1, the drill apparatus 11 drills the panel 21 at the upper end of the cavity region and the grouting apparatus 12 subsequently implements grouting to complete the repair.

In the present embodiment, a first guide rail 24 and a second guide rail 8 are further comprised; the first guide rail 24 is vertically fixed on the moving platform; and the work cabin 1 is connected to the first guide rail 24 through a connecting rod 26 and slides along the first guide rail 24 by the driving of a driving motor 23. The drill apparatus 11 and the grouting apparatus 12 are arranged on the second guide rail 8.

The moving platform is composed of a driving apparatus, a crawler belt, a driving wheel 4, a driven wheel 7 and a device carrier 2; the device carrier 2 is disposed on the crawler belt, and the driving apparatus controls the driven wheel 7 and the driving wheel 4 to rotate to drive the rotation of the crawler belt so as to move the device.

The traction apparatus comprises a hoister 17 and a traction cable 18; the traction cable 18 is connected to the moving platform, and the device is controlled to reciprocate up and down along the panel by the driving force of the moving platform and the traction of the hoister 17.

In the present embodiment, the hoister 17 is fixed on one side of the dam roof panel, the device is placed on the concrete panel 19, the traction cable 18 is released by the hoister 17 and moves downward along the panel into the water under the self-weight of the device, after the device travels to the cavity region 21 of the panel the hoister 17 is closed so as to stop the movement of the device, the work cabin vertical movement drive motor 23 is controlled at the same time so that the work cabin 1 moves downward along the first guide rail 24 to ensure that the rubber bottom edge 25 at the bottom of the work cabin 1 is pressed tightly against the concrete panel 19, then the high-pressure gas is pressed into the work cabin 1 through the pneumatic pressure tube 13 by the pneumatic pump 15, and at this time the one-way check valve 5 is automatically opened to drain the water inside the work cabin 1 from the work cabin 1 through the one-way check valve 5 until the water in the work cabin 1 is completely emptied. At this time, the pressure inside the work cabin 1 is adjusted by the pressure drainage apparatus 6 so that a certain pressure difference is formed between the internal pressure of the work cabin 1 and the external water pressure to complete the preparation for underwater repair of the cavity region of the concrete panel rock-fill dam panel.

The drill apparatus 11 is started so that the drill pipe 9 is moved to the position where the drilling is required to start drilling. When the drilling penetrates the concrete panel 19 and reaches the panel cavity region 21, the drill pipe 9 is controlled to move upward until the drill pipe 9 is disengaged from the concrete panel 19 and the drill pipe 9 is controlled to move along the second guide rail 8 to the side of the drilling position, and then the grouting apparatus 12 is started to drive the grouting head 10 to move along the second guide rail 8 to the drilling position, and the grouting head 10 is controlled by the grouting apparatus 12 to be placed inside the drilling to the panel cavity region 21, then the grouting pump 16 is started so that the grouting slurry is injected into the panel cavity region 21 through the grouting pipe 14 and the grouting head 10 until the panel cavity region 21 is filled up, then grouting head 10 is slowly lifted up while the grouting is carried out to block the drilling, and then the device is evacuated after the solidification of the grouting slurry.

When the device is evacuated, the pressure in the work cabin 1 is first adjusted to be consistent with the external water pressure by the pressure drainage apparatus 6, and the work cabin vertical movement drive motor 23 drives the work cabin 1 to move upward along the first guide rail 24 so that the work cabin 1 is disengaged from the concrete panel 19, the air inside of the pressure cabin 1 is pumped through the pressure drainage apparatus 6 so that the water slowly fills in the work cabin 1, and then the device is pulled up to the water mark by the hoister 17 to complete the evacuation of device.

Embodiment 2

The present embodiment differs from Embodiment 1 only in that it further comprises an imaging apparatus and a lighting apparatus, wherein the imaging apparatus and the lighting apparatus are arranged in the work cabin 1.

Embodiment 3

The present embodiment differs from Embodiment 1 only in that an electromagnet is arranged at the bottom of the moving platform.

Embodiment 4

The present embodiment differs from Embodiment 1 only in that the front end of the moving platform is provided with a high-pressure cleaning nozzle.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. An underwater repair system for cavity region of concrete panel rock-fill dam panel, comprising:

a moving platform, a work cabin, a pressure drainage apparatus, a traction apparatus, a positioning apparatus, a first guide rail, and a second guide rail;

the work cabin and the positioning apparatus are arranged on the moving platform, and the traction apparatus controls the movement of the moving platform on the surface of a dam concrete panel; and the positioning apparatus transmits a detection position;

the work cabin is a pressure cabin with an upper closure structure, the work cabin is connected to the pressure drainage apparatus, the work cabin is provided with a drill apparatus and a grouting apparatus; the moving platform moves to a cavity region, the pressure drainage apparatus starts to drain the water in the work cabin to form a partially closed waterless space inside the work cabin, the drill apparatus drills the panel at the upper end of the cavity region and the grouting apparatus subsequently implements grouting to complete the repair;

wherein the work cabin is connected to the first guide rail so that the work cabin vertically slidable along the first guide rail;

wherein the drill apparatus and the grouting apparatus are arranged on the second guide rail so that the drilling apparatus and the grouting apparatus are movable within the work cabin to reach a position where drilling is required.

2. The system according to claim 1, wherein the first guide rail is vertically fixed on the moving platform; and the work cabin is connected to the first guide rail through a connecting rod and slides along the first guide rail by the driving of a driving motor.

3. The system according to claim 1, wherein the edge of the bottom of the work cabin is made of a flexible rubber material; and the outer side of the flexible rubber bottom edge is provided with a flexible pressure water-stopping material so as to seal the work cabin under the pressure of water.

4. The system according to claim 1, wherein the pressure drainage apparatus comprises a pneumatic pump, a pneumatic pressure tube and a one-way check valve, wherein the one-way check valve is arranged on the work cabin, the pneumatic pressure tube is connected to the work cabin; the pneumatic pump drives to press the high-pressure gas into the work cabin through the pneumatic pressure tube, and the water in the work cabin is discharged through the one-way check valve to form a partially closed waterless space inside the work cabin.

5. The system according to claim 1, further comprising an imaging apparatus and a lighting apparatus, wherein the imaging apparatus and the lighting apparatus are arranged in the work cabin.

6. The system according to claim 1, wherein the moving platform is composed of a driving apparatus, a crawler belt, a driving wheel, a driven wheel and a device carrier; the device carrier is disposed on the crawler belt, and the driving apparatus controls the driven wheel and the driving wheel to rotate to drive the rotation of the crawler belt so as to move the device.

7. The system according to claim 1, wherein the traction apparatus comprises a hoister and a traction cable; the traction cable is connected to the moving platform, and the device is controlled to reciprocate up and down along the panel by the driving force of the moving platform and the traction of the hoister.

8. The system according to claim 1, wherein an electromagnet is provided at the bottom of the moving platform.

9. The system according to claim 1, wherein the front end of the moving platform is provided with a high-pressure cleaning nozzle.

* * * * *